US007248227B2

(12) United States Patent
Chen

(10) Patent No.: US 7,248,227 B2
(45) Date of Patent: Jul. 24, 2007

(54) DIPOLE ANTENNA

(75) Inventor: Chih-Lung Chen, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/306,903

(22) Filed: Jan. 16, 2006

(65) Prior Publication Data

US 2007/0097008 A1 May 3, 2007

(30) Foreign Application Priority Data

Nov. 3, 2005 (TW) ..... 94138585 A

(51) Int. Cl.
*H01Q 9/28* (2006.01)
*H01Q 1/38* (2006.01)

(52) U.S. Cl. ..... 343/795; 343/795; 343/700 MS

(58) Field of Classification Search ..... 343/793, 343/795, 700 MS
See application file for complete search history.

(56) References Cited

U.S. PATENT DOCUMENTS 5,387,919 A * 2/1995 Lam et al. ..... 343/821
5,754,145 A * 5/1998 Evans ..... 343/795
6,222,494 B1 * 4/2001 Erkocevic ..... 343/790
6,337,666 B1 * 1/2002 Bishop ..... 343/795
6,906,678 B2 * 6/2005 Chen ..... 343/795
2005/0035919 A1 2/2005 Yang et al.

FOREIGN PATENT DOCUMENTS

RU 2 144 247 C1 2/2000
WO WO 97/08774 A2 3/1997

OTHER PUBLICATIONS

Tai-Lee Chen, "Multi-band printed sleeve dipole antenna" Electronics Letters, vol. 39 No. 1, 9th Jan. 2003, pp 14-15, X006019583.

* cited by examiner

*Primary Examiner*—Shih-Chao Chen
(74) *Attorney, Agent, or Firm*—Winston Hsu

(57) ABSTRACT

Disposing an additional sleeve-shaped structure, which is also called a sleeve, on a first radiator of both resonant radiators of a dipole antenna so that a cavity is formed between the additional radiator and a second resonant radiator of the dipole antenna. An effective bandwidth of the dipole antenna is increased significantly by a capacitance effect caused by the cavity so that more channels can be received by a general digital television broadband antenna while the dipole antenna is applied on the digital television broadband antenna.

22 Claims, 6 Drawing Sheets

DIPOLE ANTENNA

BACKGROUND OF THE INVENTION

1. Field of the Invention

The present invention relates to a dipole antenna, and more particularly, to a dipole antenna formed on a substrate for transmitting a signal.

2. Description of the Prior Art

The usage of a general dipole antenna is determined by the effective bandwidth of the general dipole antenna. The broadest usage of the general dipole antenna is the integrated digital television broadband antenna applied on a general digital household appliance. As is well known in the art, digital household appliances typically require a bandwidth between 460 MHz and 860 MHz. However, the general dipole antenna barely achieves the required bandwidth of the general digital household appliance because of its structural limitations. The effective bandwidth of the general digital household appliance barely reaches roughly twenty percent of the required bandwidth. Additionally, this limitation results in significant limitations in the effective bandwidth of an integrated digital television broadband antenna and the usage of the general digital household appliance.

Please refer to FIG. 1, which is a diagram of a conventional dipole antenna 100. The dipole antenna 100 is formed on a substrate 102 for transmitting a first signal. As shown in FIG. 1, the dipole antenna 100 comprises a first radiator 104, a feeding line 106, a signal source 108, a ground line 110, and a second radiator 112. The feeding line 106 is connected to an end of the first radiator 104. The signal source 108 is connected to the feeding line 106 and utilized for providing the first signal. The ground line 110 is connected to the signal source 108. The second radiator 112 is connected to an end of the ground line 110. The dipole antenna 100 transmits and receives signals via the resonance between the first radiator 104 and the second radiator 112. In other words, the first radiator 104 and the second radiator 112 are a pair of resonant radiators. The lengths of the first radiator 104 and the second radiator 112 affect the bandwidths of transmitting and receiving signals. Therefore, the lengths of the first radiator 104 and the second radiator 112 are set to be a quarter of the wavelength of the first signal thereby providing efficient power consumption as the dipole antenna 100 transmits the first signal. The dipole antenna 100 thus transmits the first signal in a specific effective bandwidth. However, the specific effective bandwidth is only capable of reaching twenty percent of the required bandwidth as mentioned previously. Therefore, it is apparent that new and improved devices are needed for solving said problem.

SUMMARY OF THE INVENTION

Therefore, the claimed invention provides a dipole antenna formed on a substrate for transmitting a signal. The dipole antenna includes a first radiator, a second radiator for resonating with the first radiator for transmitting a signal, and a sleeve-shaped structure. The first radiator is disposed within said structure but is not in contact with said structure. The second radiator is connected to the bottom of the sleeve-shaped structure.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, consumer electronic equipment manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
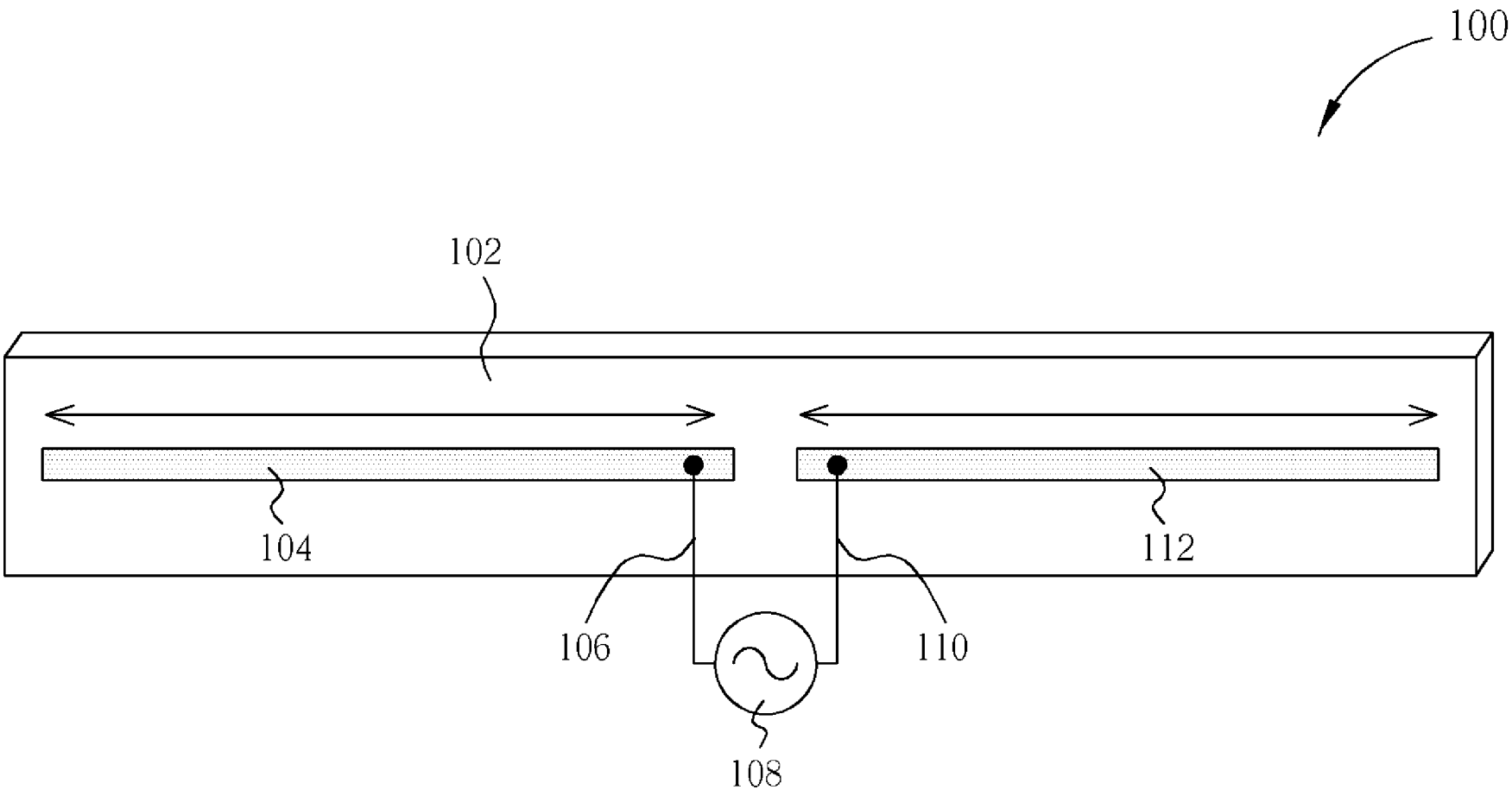
Fig. 1 Prior Art
FIG. 1 is a diagram of a conventional dipole antenna.
Figure 2:
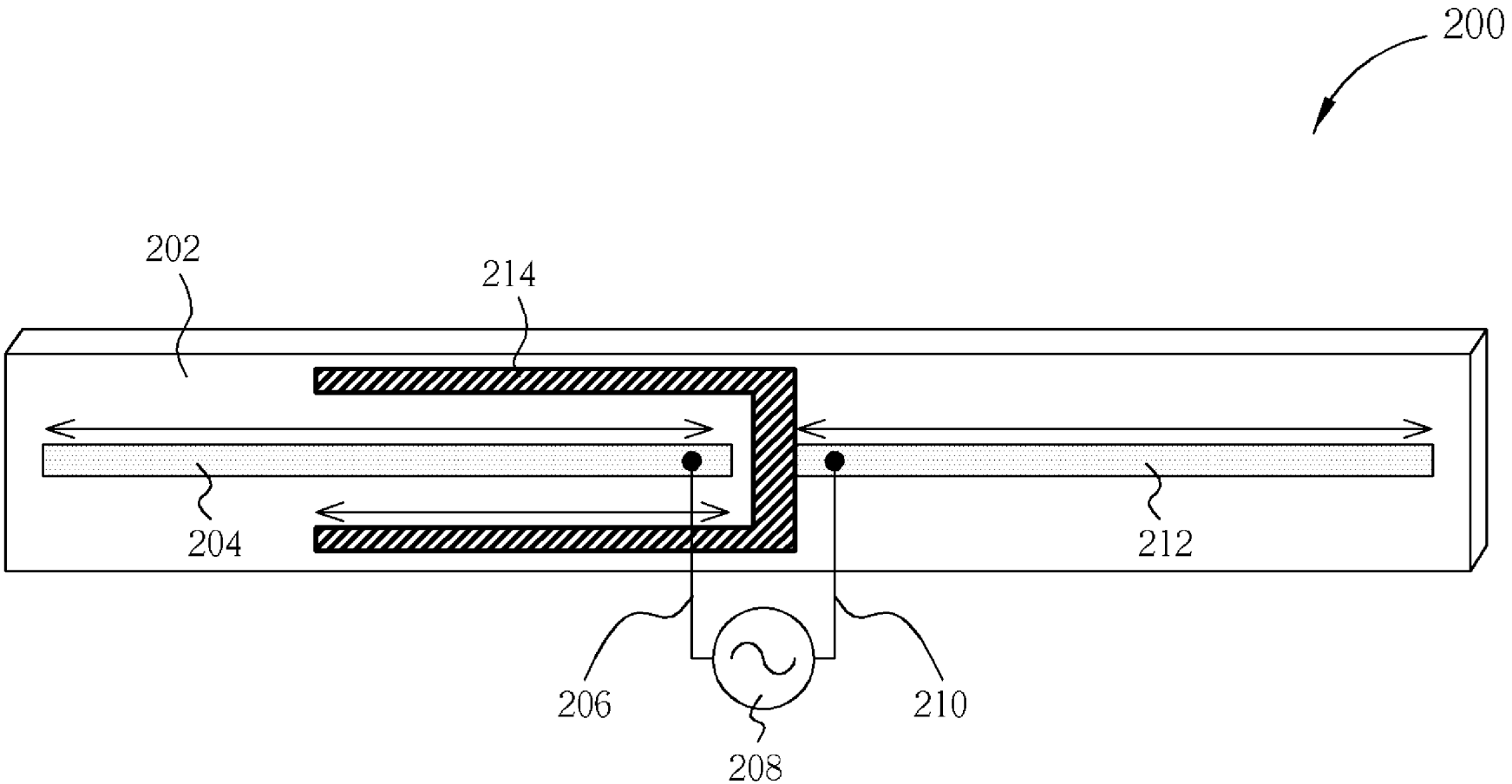
FIG. 2 is a diagram of a dipole antenna of the present invention.

Please refer to FIG. 2, which is a diagram of a dipole antenna 200 of the present invention. The dipole antenna 200 is formed on a substrate 202 for transmitting a second signal. The dipole antenna 200 comprises a first radiator 204, a feeding line 206, a signal source 208, a ground line 210, a second radiator 212, and a sleeve-shaped (or U-shaped) structure 214. The length of the first radiator 204 is about a quarter of the wavelength of the second signal. The feeding line 206 is connected to the first radiator 204. The signal source 208 is connected to the feeding line 206 and is utilized to provide the second signal. The ground line 210 is connected to the signal source 208. The second radiator 212 is connected to the ground line 210. The length of the second radiator 212 is about a quarter of the wavelength of the second signal. The sleeve-shaped structure has an opening and a closed bottom portion. The closed bottom portion of the sleeve-shaped structure 214 is perpendicularly connected to the second radiator 212. A measurement of the length of the inner-side of the sleeve-shaped structure 214 is about a quarter of the wavelength of the second signal. The sleeve-shaped structure 214 may also be denoted as a sleeve. The first radiator 208 and the second radiator 212 are resonant radiators in a pair.

As shown in FIG. 2, the first radiator 204 is inserted in the sleeve-shaped structure 214 through the opening and disconnected from the closed bottom portion. According to the disposition of the signal source 208, the orientation of the current transmitted through the first radiator 204 must be adverse to the orientation of the current transmitted through the second radiator 212. Therefore, the adverse orientations of the currents and the sleeve-shaped structure 214 lead to a capacitance effect between the sleeve-shaped structure 214 and the first radiator 204. The substrate 202 is a printed circuit board (PCB) for increasing the magnitude of the capacitance effect. Therefore, an effective bandwidth of the dipole antenna 200 is increased significantly whereby the effective bandwidth of the dipole antenna 200 reaches more than seventy percent of the required bandwidth, which ranges from 460 MHz to 860 MHz as mentioned previously.

Figure 3:
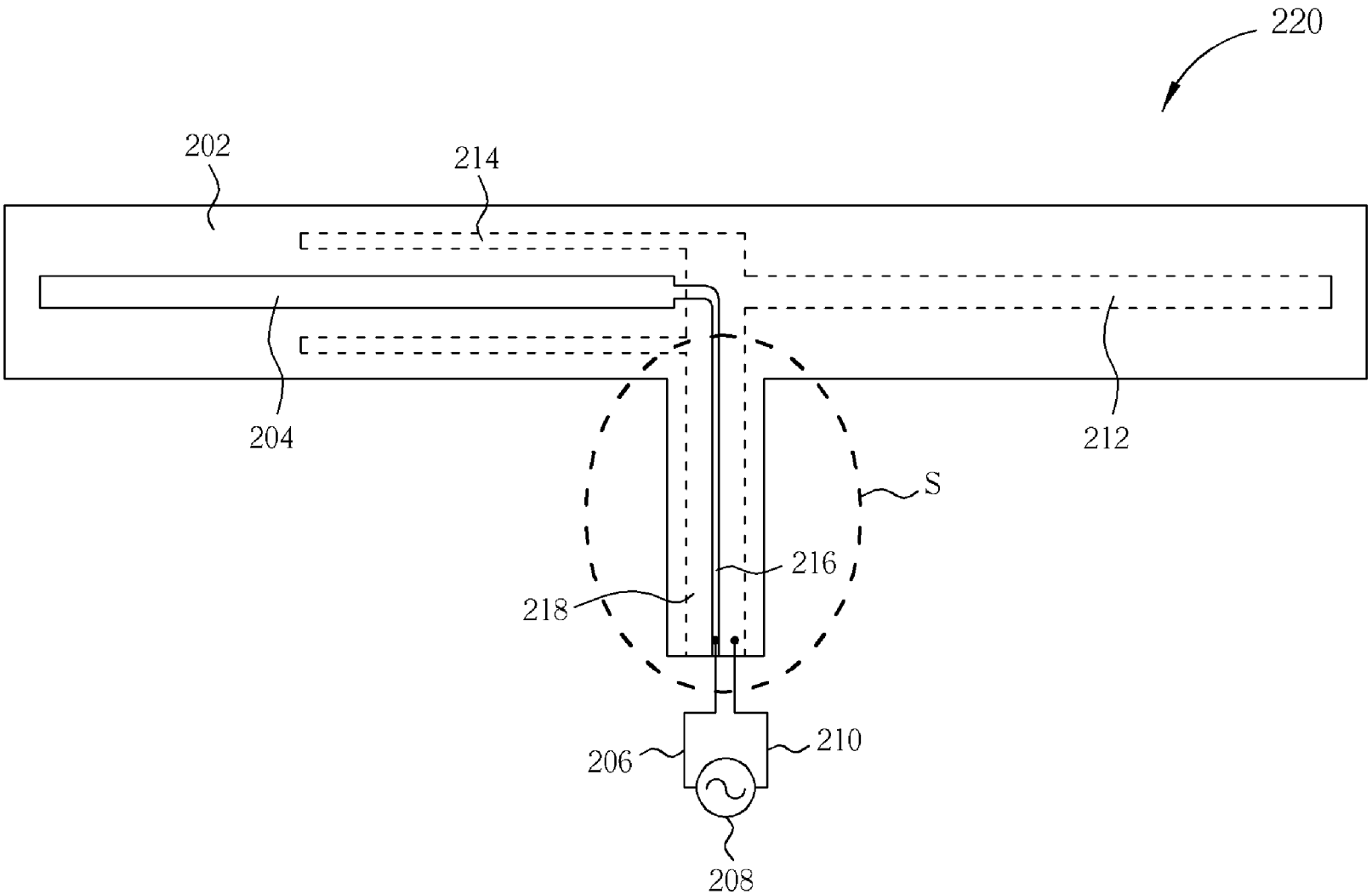
FIG. 3 is a diagram of a dipole antenna of the present invention.

Please refer to FIG. 3, which is a diagram of a dipole antenna 220 of the present invention. The dipole antenna 220 feeds a signal with a microstrip structure. The dipole antenna 220 is derived by adding the microstrip structure to the dipole antenna 200 shown in FIG. 2. As shown in FIG. 3, a connector 218 extends from the sleeve-shaped structure 214 and is connected to the ground line 210. A conductive wire 216 is connected to an end of the first radiator 204 and an end of the connector 218, and is utilized to feed a signal of the signal source 208 to the first radiator 204. The connector 218 is utilized to feed the signal to the second radiator 212 through the ground line 210. A microstrip structure comprises the conductive wire 216, the connector 218, and part of the substrate 202, and the microstrip structure is denoted as a region S surrounded by a dotted line shown in FIG. 3. Therefore, by way of the conductive wire 216, the dipole antenna 220 may be formed in a smaller substrate 202 than the dipole antenna 200. The practicability of the dipole antenna 220 on the digital television broadband antenna is thus enhanced.

Figure 4:
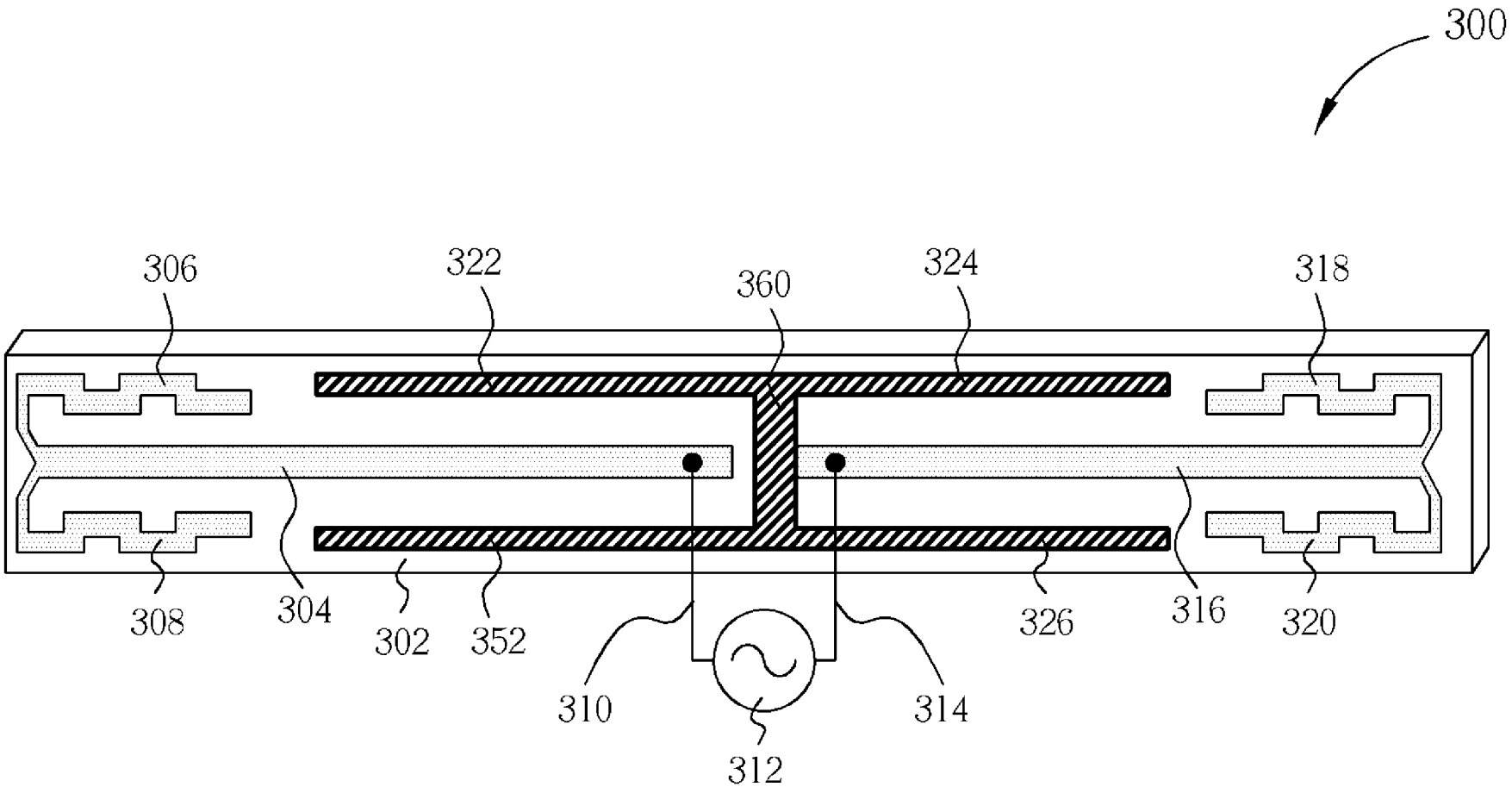
FIG. 4 is a diagram of a dipole antenna of the present invention.

Please refer to FIG. 4, which is a diagram of a dipole antenna 300 of the present invention. The dipole antenna 300 is formed on a substrate 302 for transmitting a third signal. The dipole antenna 300 comprises a first radiator 304, a first branch 306, a second branch 308, a feeding line 310, a signal source 312, a ground line 314, a second radiator 316, a closed portion 360, a first beam 352, a second beam 322, a third branch 318, a fourth branch 320, a third beam 326, and a fourth beam 324. The length of the first radiator 304 is about a quarter of the wavelength of the third signal. The first branch 306 has an end connected to the second end of the first radiator 304 and bends toward the first end of the first radiator 304. The sum of the lengths of the first radiator 304 and the first branch 306 is about a quarter of the wavelength of the third signal. The second branch 308 has an end connected to the second end of the first radiator 304 and bends toward the first end of the first radiator 304. The sum of the lengths of the first radiator 304 and the second branch 308 is about a quarter of the wavelength of the third signal. The feeding line 310 is connected to the second end of the first radiator 304. The signal source 312 is connected to the feeding line 310. The ground line 314 is connected to the signal source 312. The second radiator 316 has a first end connected to the ground line 314. The closed portion 360 is connected to the second radiator 316. The first beam 352 is connected to the closed portion 360. The second beam 322 is also connected to the closed portion 360. A first opening comprises the closed portion 360, the first beam 352, and the second beam 322. A measurement of the length of the inner-side of the first opening is about a quarter of the wavelength of the third signal. The first radiator 304 is inserted in the first sleeve-shaped structure and disconnected from the first opening. The third branch 318 has an end connected to the second end of the second radiator 316 and bends toward the first end of the second radiator 316. The sum of the lengths of the second radiator 316 and the third branch 318 is about a quarter of the wavelength of the third signal. The fourth branch 320 has an end connected to the second end of the second radiator 316 and bends toward the first end of the second radiator 316. The sum of the lengths of the second radiator 316 and the fourth branch 320 is about a quarter of the wavelength of the third signal. The third beam 326 extends from the closed portion 360. The fourth beam 324 extends from the closed portion 360 also. A second opening comprises the closed portion 360, the third beam 326, and the fourth beam 324. A measurement of the length of the inner-side of the second opening is about a quarter of the wavelength of the third signal. The second radiator 316 is inserted in the second opening and connected to the second opening. The first radiator 304 and the second radiator 316 are resonant radiators in a pair.

According to the disposition of the signal source 312, the orientation of the current transmitted through the first radiator 304 must be adverse to the orientation of the currents transmitted through the first beam 352 and the second beam 322. Therefore, a capacitance effect is generated from the adverse orientations and the first opening. The substrate 302 is a printed circuit board for increasing the magnitude of the capacitance effect. Therefore, an effective bandwidth of the dipole antenna 300 is thereby increased significantly so that the effective bandwidth of the dipole antenna 300 reaches more than seventy percent of the required bandwidth, which ranges from 460 MHz to 860 MHz as mentioned previously.

As shown in FIG. 4, the sum of the lengths of the first radiator 304 and the first branch 306 is about a quarter of the wavelength of the third signal. Such disposition is utilized for decreasing the size of the dipole antenna 300 on the substrate 302. The practical utilization of the dipole antenna 300 for a general digital television broadband antenna is thus increased. The disposition, which sets the sum of the first radiator 304 and the second branch 308 equal to a quarter of the wavelength of the third signal, is applied for the same reason. The first branch 306 and the second branch 308 must be connected to the first end of the first radiator 304 for allowing the dipole antenna 300 to transmit the third signal in a concentrated orientation in the air. Similarly, the dispositions, which set the sum of the lengths of the second radiator 316 and the third branch 318 about a quarter of the wavelength of the third signal and set the sum of the lengths of the second radiator 316 and the fourth branch 320 about a quarter of the wavelength of the third signal, are also utilized for decreasing the size of the dipole antenna 300 on the substrate 302. Therefore, the practical utilization of the dipole antenna 300 for the general digital television broadband antenna is thus also enhanced. The third branch 318 and the fourth branch 320 must be connected to the first end of the second radiator 316 for allowing the dipole antenna 300 to transmit the third signal in a concentrated orientation in the air. Moreover, applying such dispositions applied on the first end of the first radiator 304 and the second end of the second radiator 316 simultaneously for decreasing the size of the dipole antenna 300 on the substrate 302 are necessary. Therefore, the basic structure of the conventional dipole antenna 100 is also maintained in the dipole antenna 300 of the present invention as well as the dipole antenna 200 of the present invention. The basic structure comprises that the lengths of the equivalent radiators disposed at both sides of the signal source 312 are equivalent.

As shown in FIG. 4, note that the dispositions of the third beam 326 and the fourth beam 324 are not necessary, but the dispositions must satisfy certain conditions. The first condition: the second opening comprises the fourth beam 324, the third beam 326, and the closed portion 360. The second condition: a measurement of the length of the inner-side of the second opening is about a quarter of the wavelength of the third signal. The third condition: the second radiator 316 is inserted in the second opening. In other words, without the third beam 326 and the fourth beam 324, the effect of reaching more than seventy percent of the required bandwidth is still maintained in the dipole antenna 300.

Figure 5:
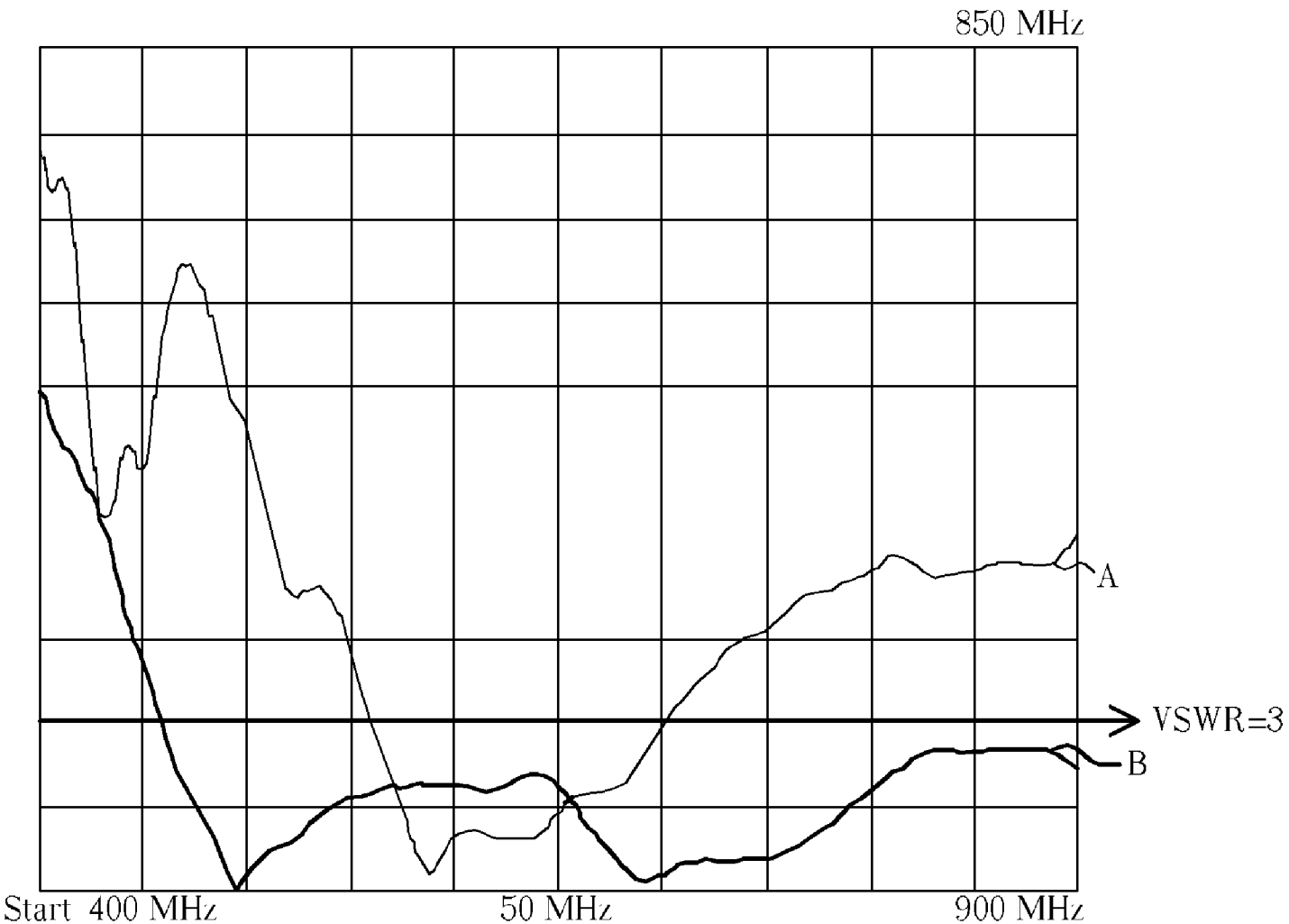
FIG. 5 is an experimental comparison graph of a conventional dipole antenna and dipole antennas of the present invention.

Please refer to FIG. 5, which is an experimental comparison graph of the conventional dipole antenna 100 and the dipole antennas 200, 300 of the present invention. As shown in FIG. 5, the dipole antennas 100, 200, and 300 are operated while the voltage standing wave ratio (VSWR) is 3. As mentioned previously regarding the dipole antenna 100, the effective bandwidth of the dipole antenna 100 is roughly twenty percent of the required bandwidth. In FIG. 5, two intersections are generated by the waveform A of the dipole antenna 100 and the datum line representing the voltage standing wave ratio (VSWR) is 3. The segment formed by the two intersections covers roughly twenty-five percent of the required bandwidth. An intersection is generated by the waveform B of the dipole antenna 200 or 300 and the datum line representing the voltage standing wave ratio is 3. A segment extends from the intersection to the right terminal of the datum line covers at least eighty percent of the required bandwidth.

Figure 6:
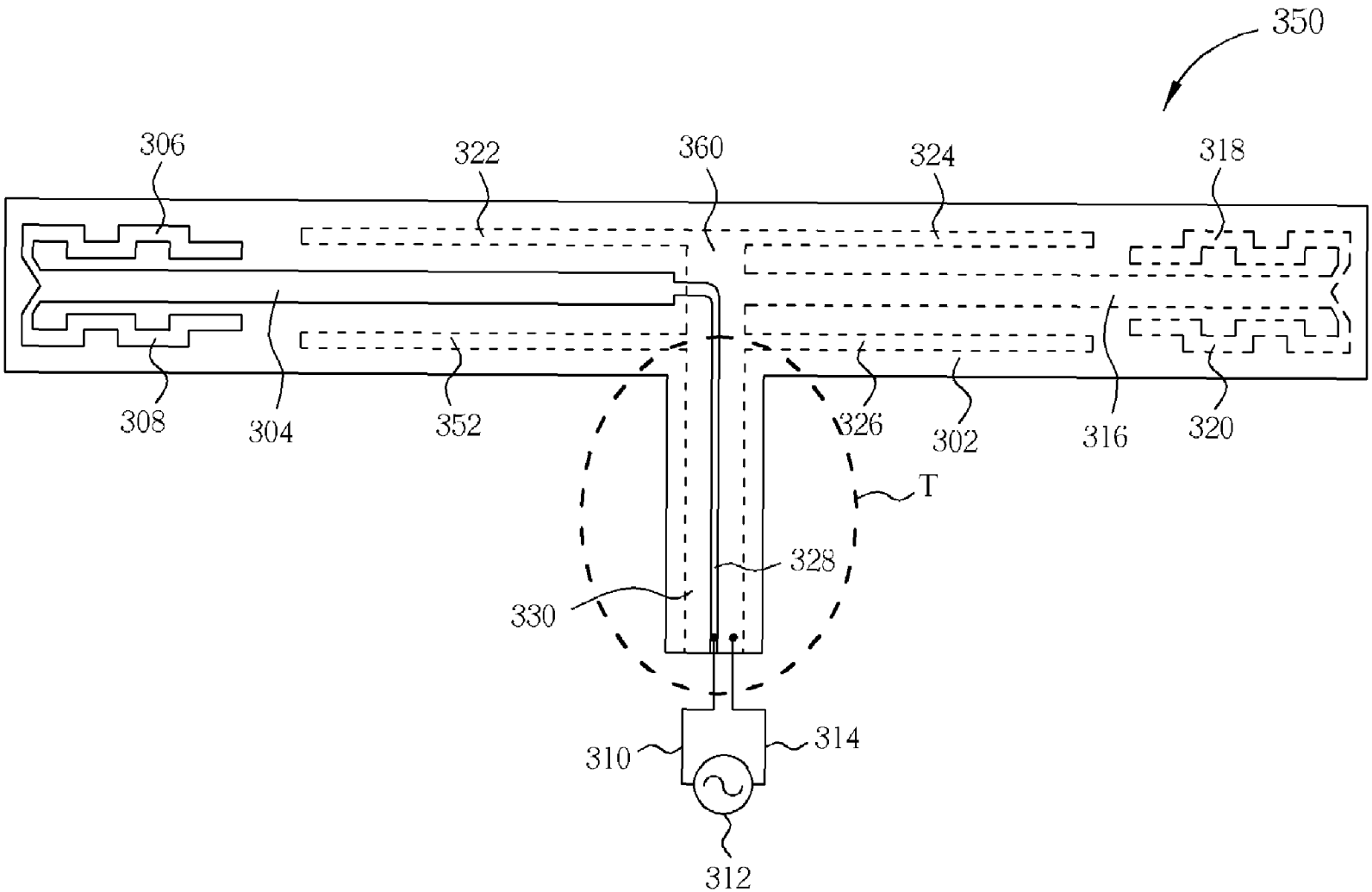
FIG. 6 is a diagram of the dipole antenna utilizing a microstrip structure for feeding a signal in the present invention.

Please refer to FIG. 6, which is a diagram of the dipole antenna 350 utilizing a microstrip structure for feeding a signal in the present invention. As shown in FIG. 6, a first end of a conductive wire 328 is connected to the second end of the first radiator 304. A second end of the conductive wire is connected to the feeding line for feeding a signal. A connector 330 extends from the second beam 322. A microstrip structure comprises the conductive wire 328, the connector 330, and part of the substrate 302, and is denoted as a region T surrounded in a dotted line in FIG. 6. Therefore, the dipole antenna 350 is formed on a smaller substrate 302 by utilizing the conductive wire 328, and the size of the dipole antenna 350 is also decreased. Therefore, the practical utilization the dipole antenna 350 for the general digital television broadband antenna is thus enhanced.

In summary, the present invention provides a dipole antenna for enhancing a capacitance effect with a sleeve-shaped structure and a substrate for enhancing an effective bandwidth from twenty percent to more than seventy percent of the required bandwidth. Therefore, when a dipole antenna of the present invention is utilized with a general digital television broadband antenna, the number of receivable channels is also increased. Additionally, the size of a dipole antenna of the present invention may also be decreased by utilizing a microstrip structure for enhancing the practicability of the dipole antenna of the present invention without affecting the effective bandwidth. When the dipole antenna of the present invention is utilized in conjunction with the general digital television broadband antenna, the decreased size of the dipole antenna of the present invention also enhances the practicability of the dipole antenna of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dipole antenna formed on a substrate for transmitting a signal, the dipole antenna comprising:

a first radiator;

a second radiator resonating with the first radiator for transmitting the signal; and a sleeve-shaped structure having an opening and a closed bottom portion connected to the second radiator, wherein the first radiator is inserted in the sleeve-shaped structure through the opening and disconnected from the closed bottom portion of the sleeve-shaped structure.

2. The dipole antenna of claim 1 formed on a printed circuit board (PCB).

3. The dipole antenna of claim 1 wherein the length of the first radiator is about a quarter of the wavelength of the signal fed into the first radiator.

4. The dipole antenna of claim 1 wherein the length of the second radiator is about a quarter of the wavelength of the signal fed into the second radiator.

5. The dipole antenna of claim 1 wherein a measurement of the length of the inner-side of the sleeve-shaped structure is about a quarter of the wavelength of the signal fed into the second radiator.

6. The dipole antenna of claim 1 further comprising a connector extending from the sleeve-shaped structure.

7. The dipole antenna of claim 6 further comprising a conductive wire connected to an end of the first radiator and an end of the connector for feeding the signal into the first radiator and the second radiator.

8. A dipole antenna formed on a substrate and utilized for transmitting a signal, the dipole radiator comprising:

a first radiator having a first end and a second end, the second end comprising a first branch and a second branch;

a second radiator having a first end and a second end, the second end comprising a third branch and a fourth branch; and a sleeve-shaped structure having a closed portion connected to a first beam and a second beam to form a first opening, wherein a first end of the second radiator is connected to the closed portion of the sleeve-shaped structure, and the first radiator is inserted in the sleeve-shaped structure through the first opening and disconnected from the closed portion of the sleeve-shaped structure.

9. The dipole antenna of claim 8 wherein the sum of the lengths of the first radiator and the first branch is about a quarter of the wavelength of the signal fed into the first radiator.

10. The dipole antenna of claim 8 wherein the sum of the lengths of the first radiator and the second branch is about a quarter of the wavelength of the signal fed into the first radiator.

11. The dipole antenna of claim 8 wherein the sum of the lengths of the second radiator and the third branch is about a quarter of the wavelength of the signal fed into the second radiator.

12. The dipole antenna of claim 8 wherein the sum of the lengths of the second radiator and the fourth branch is about a quarter of the wavelength of the signal fed into the second radiator.

13. The dipole antenna of claim 8 wherein the sum of the lengths of the first beam, the bottom, and the second beam is about a quarter of the wavelength of the signal fed into the second radiator.

14. The dipole antenna of claim 8 further comprising a third beam and a fourth beam respectively connected to the closed portion of the sleeve-shaped structure for forming a second opening, and the second radiator inserted in the second opening.

15. The dipole antenna of claim 14 wherein the sum of the lengths of the third beam, the closed portion, and the fourth beam is about a quarter of the wavelength of the signal fed into the second radiator.

16. The dipole antenna of claim 14 further comprising a connector extending from the first opening and the second opening.

17. The dipole antenna of claim 8 further comprising a conductive wire connected to the first end of the first radiator and an end of the connector and utilized for feeding the signal into the first radiator and the second radiator.

18. The dipole antenna of claim 8 formed on a printed circuit board.

19. The dipole antenna of claim 8 wherein the first branch extends from the second end of the first radiator and bends toward the first end of the first radiator.

20. The dipole antenna of claim 8 wherein the second branch extends from the second end of the first radiator and bends toward the first end of the first radiator.

21. The dipole antenna of claim 8 wherein the third branch extends from the second end of the second radiator and bends toward the first end of the second radiator.

22. The dipole antenna of claim 8 wherein the fourth branch extends from the second end of the second radiator and bends toward the first end of the second radiator.

* * * * *